US005987748A

United States Patent [19]

Calloway

[11] Patent Number: 5,987,748

[45] Date of Patent: Nov. 23, 1999

[54] METHOD OF MAKING INK ROLLER ASSEMBLY

[75] Inventor: Ronald G. Calloway, Maineville, Ohio

[73] Assignee: Monarch Marking Systems, Inc., Dayton, Ohio

[21] Appl. No.: 09/127,392

[22] Filed: Jul. 31, 1998

[51] Int. Cl.[6] ..... B41F 31/26

[52] U.S. Cl. ..... 29/895.21; 101/348; 101/351.7; 29/895.23; 29/446; 492/39

[58] Field of Search ..... 101/348, 351.7, 101/375, 376, 217, 367; 400/202.4; 492/39, 40; 29/895.21, 895.23, 445, 446, 448

[56] References Cited

U.S. PATENT DOCUMENTS

| | | | |
|---|---|---|---|
| 2,721,601 | 10/1955 | Spencer | 101/375 |
| 3,146,709 | 9/1964 | Bass et al. | 101/375 |
| 3,336,866 | 8/1967 | Hawthorne | 101/348 |
| 3,714,693 | 2/1973 | Peterson | 492/56 |
| 3,724,047 | 4/1973 | Peterson | 492/48 |
| 3,738,269 | 6/1973 | Wagner | 101/367 |
| 4,030,415 | 6/1977 | Fellows | 101/382.1 |
| 4,399,751 | 8/1983 | Kessler | 101/348 |
| 4,409,896 | 10/1983 | Hamisch, Jr. | 101/367 |
| 4,416,201 | 11/1983 | Kessler | 101/348 |
| 5,215,013 | 6/1993 | Vrotacoe et al. | 101/217 |
| 5,497,549 | 3/1996 | Rademacher | 29/895.21 |
| 5,706,731 | 1/1998 | Francille et al. | 101/375 |
| 5,845,574 | 12/1998 | Dilling et al. | 101/351.6 |

OTHER PUBLICATIONS

U.S. Application No. 08/988,256, filed Dec. 10, 1997.

*Primary Examiner*—Edgar Burr
*Assistant Examiner*—Leslie J. Grohusky
*Attorney, Agent, or Firm*—Joseph J. Grass

[57] ABSTRACT

There is disclosed an ink roller assembly and a method of making an ink roller assembly. The assembly includes a base comprised of closely spaced connected discs providing capillary chambers and a porous sleeve. The method uses air to expand the porous sleeve while the sleeve is being slipped onto the base.

2 Claims, 3 Drawing Sheets

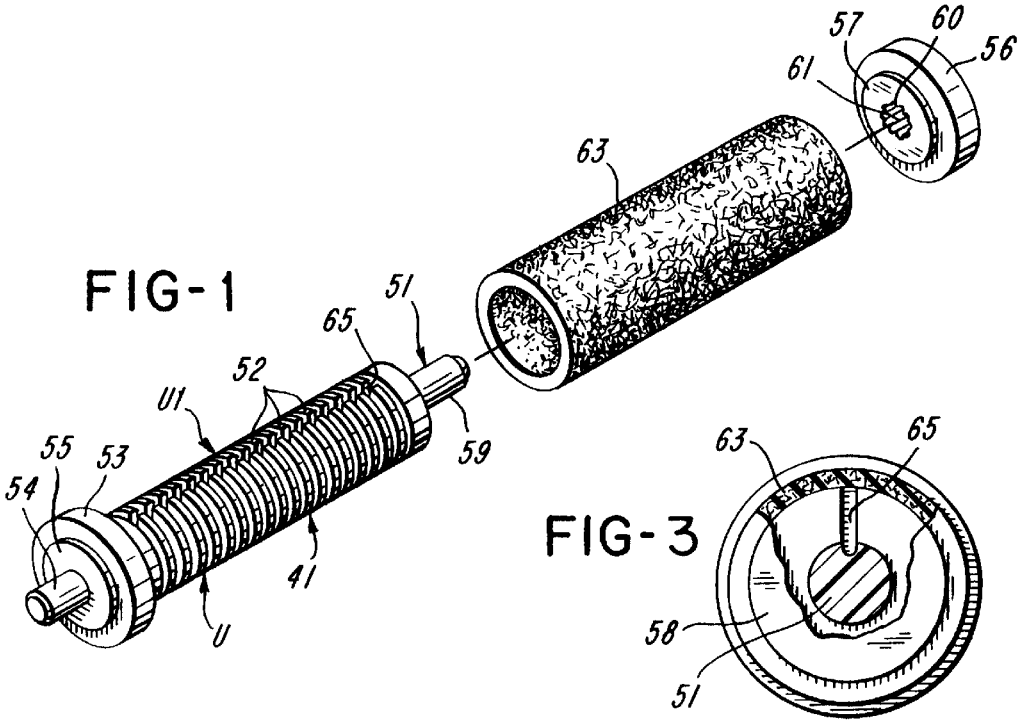
FIG-1
FIG-3
57
60
56
61
63
51
65
52
U1
55
53
54
59
41
U
63
65
58
51
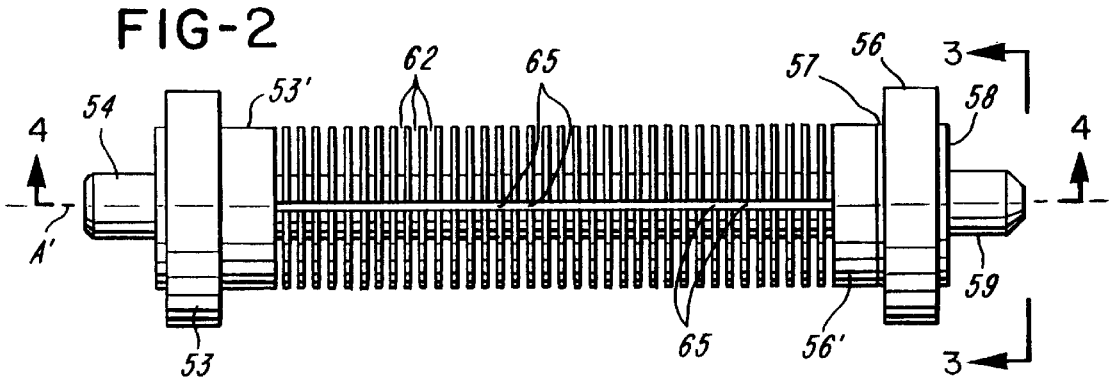
FIG-2
62
65
56
3
57
53'
58
54
4
4
A'
59
53
65
56'
3
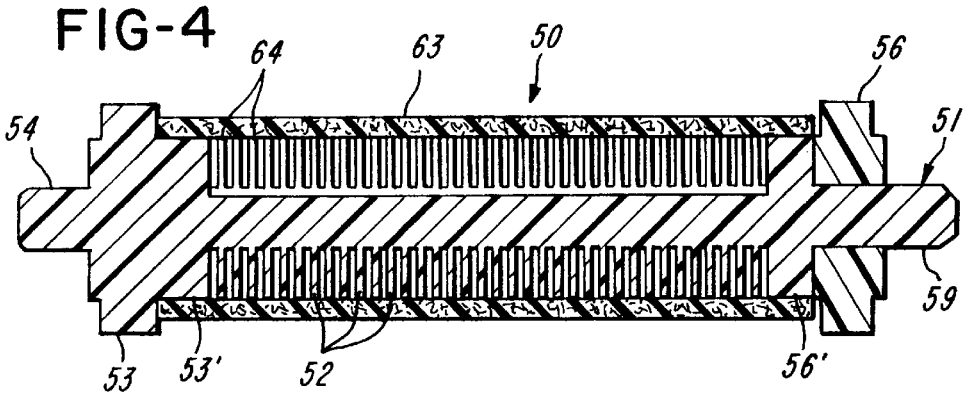
FIG-4
64
63
50
56
54
51
59
53
53'
52
56'

METHOD OF MAKING INK ROLLER ASSEMBLY

CROSS-REFERENCE TO RELATED APPLICATION

Application Ser. No. 08/988,256, filed Dec. 10, 1997 is a related application.

BACKGROUND OF THE INVENTION

1. Field of the Invention

The invention relates to the art of making ink roller assemblies.

2.

Brief Description of the Prior Art

The following are made of record: U.S. Pat. Nos. 3,738,269; 4,409,896 and 4,416,201; and U.S. application Ser. No. 08/988,256, filed Dec. 10, 1997. Certain prior art attempts to assemble porous sleeves onto bases have required the sleeve to be inked; in this method the ink acts as a lubricant. Attempts to manually slip an uninked sleeve onto a base with discs have shown this to be a highly time-consuming approach which often resulted in damage to the porous sleeve. The use of a mandrel to apply the inked sleeve to the base is inefficient.

SUMMARY OF THE INVENTION

The invention relates to an improved method of making an ink roller assembly. An ink roller assembly to which the method of the invention is applicable has a generally cylindrical base and a porous sleeve received on the base. Due to friction between the sleeve and the base, there is resistance to sliding or slipping the sleeve onto the base. This is especially the case when the inside diameter of the sleeve is less than the outside diameter of the base, or when the surface of the base presents too much resistance as the sleeve is slipped onto the base, or when both of these conditions exist. This method is especially useful where the outer surface has a configuration which is other than smooth as in the case where the base is comprised of closely spaced discs, wherein the spaces between the discs hold ink by capillary action. The method according to one embodiment of the invention includes the steps of providing a generally cylindrical, elongate base with a series of spaced connected discs to provide capillary passages therebetween, providing a porous tubular sleeve with an interior diameter less than the outside diameter of the base, slipping the sleeve part way onto the base, using air to expand the sleeve and slipping the expanded sleeve onto the base, and thereafter inking the base and the sleeve. It is preferred that the air used to expand the sleeve be under pressure while the sleeve is being slipped onto the base.

BRIEF DESCRIPTION OF THE DRAWINGS

FIG. 1 is an exploded perspective view of an ink roller assembly which can be assembled in accordance with the method of the invention;

FIG. 2 is a top plan view of the ink roller assembly, but omitting the sleeve;

FIG. 3 is a partly broken away end elevational view taken along line 3—3 of FIG. 2;

FIG. 4 is a vertical sectional view of the ink roller assembly taken along line 4—4 of FIG. 2;

DETAILED DESCRIPTION OF THE PREFERRED EMBODIMENT

Figure 5:
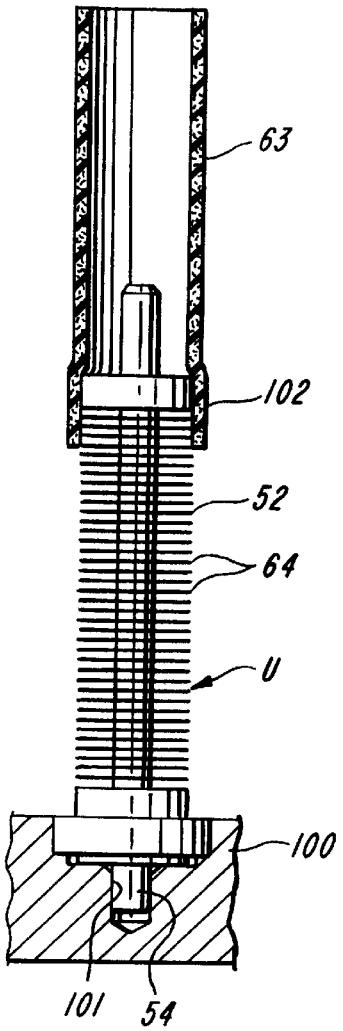
FIG. 5 is a partly sectional diagrammatic view showing the base diagrammatically and showing the sleeve partially assembled onto the base.
Figure 6:
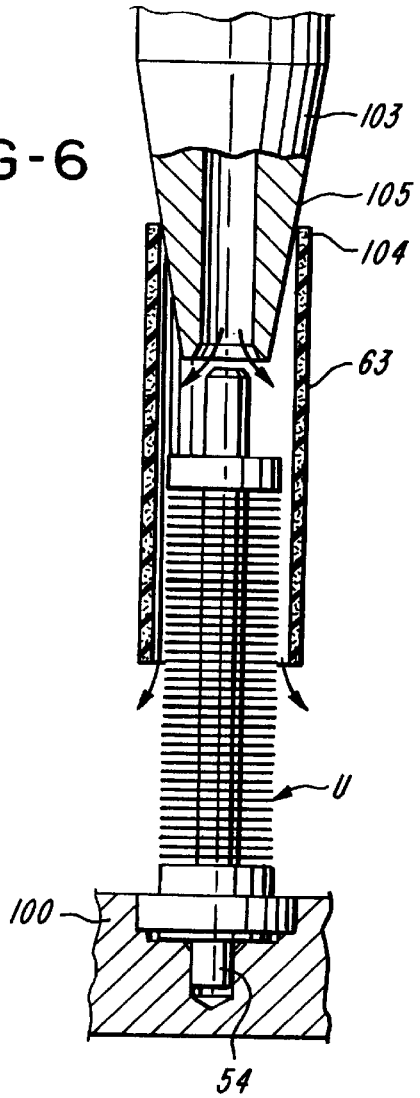
FIG. 6 is a partly sectional view similar to FIG. 5, but showing the sleeve being further assembled onto the sleeve.

Referring first to FIGS. 1 through 4 of the drawings, there is shown an ink roller assembly 50 similar to one of the embodiments in U.S. patent application Ser. No. 08/988,256 filed Dec. 10, 1997, and, accordingly the same reference characters are used to designate like components. The disclosure of application Ser. No. 08/988,256 is incorporated herein by reference.

With reference to FIGS. 1 through 4, the ink roller assembly 50 includes a base U having capillary ink retaining unit U1 and a porous sleeve 63. The sleeve 63 has a uniform inside diameter and a uniform outside diameter and therefore, a constant thickness. The unit U1 has an axis A' and a shaft or shaft portion 51 coaxial with the axis A'. The unit U1 has a series of closely spaced discs 52 with intervening capillary chambers 62 for retaining ink. The shaft 51 has stub ends 54 and 59. A flange 53 is formed integrally with the shaft 51 and a shoulder 55. A flange or disc 56 has integral projections 57 and 58. There are passages 65 which interconnect the capillary chambers 62. The only difference between the ink roller assembly of FIGS. 1 through 6 and the disclosure of application Ser. No. 08/988,256 is that in the embodiment of FIGS. 1 through 4, there are wide land areas 53' and 56' beyond the discs 52 to provide a good seal between the sleeve 63 and the base U to prevent leakage of ink from the capillary passages 62.

With reference to FIG. 5, the base U is shown to be positioned vertically in a holder 100. Specifically, the holder 100 includes a cavity 101 which receives the stub end 54 and the flange 53. The sleeve 63 is shown to have been slipped or slid partially into the base U. This can be done by manually grasping end portion 102 of the sleeve 63 and slipping it onto end portion of the base U. As shown in FIG. 5, the portion of the sleeve 63 above the base U has an inside diameter less than the outside diameter of the base U at the peripheries of the base U. It is apparent that the end portion 102 has been stretched over some of the discs 52. While the sleeve 63 can be manually slipped onto the base U to the position shown in FIG. 5, the relative dimensions of the sleeve 63 and the base U and the surfaces provided by the peripheries 64 of the spaced discs make it difficult to manually insert the sleeve 63 fully to the position shown in FIG. 7. Therefore, according to the invention, a nozzle 103 is inserted into open end 104 of the sleeve 63. It is preferred that the nozzle 103 have a tapered outer surface 105 and a size to contact the upper end 104 of the sleeve 63. When air under pressure is admitted into the interior space of the sleeve 63, the sleeve 63 is expanded outwardly of the base U, as shown. The sleeve 63 is thus able to be slipped over the base U and moved to the position shown in FIG. 7. When the sleeve 63 is expanded, the sleeve 63 can be manually moved toward the FIG. 7 position. Also, descent of the sleeve 63 is facilitated by gravity and by the downward force exerted by the nozzle 103.

Figure 8:
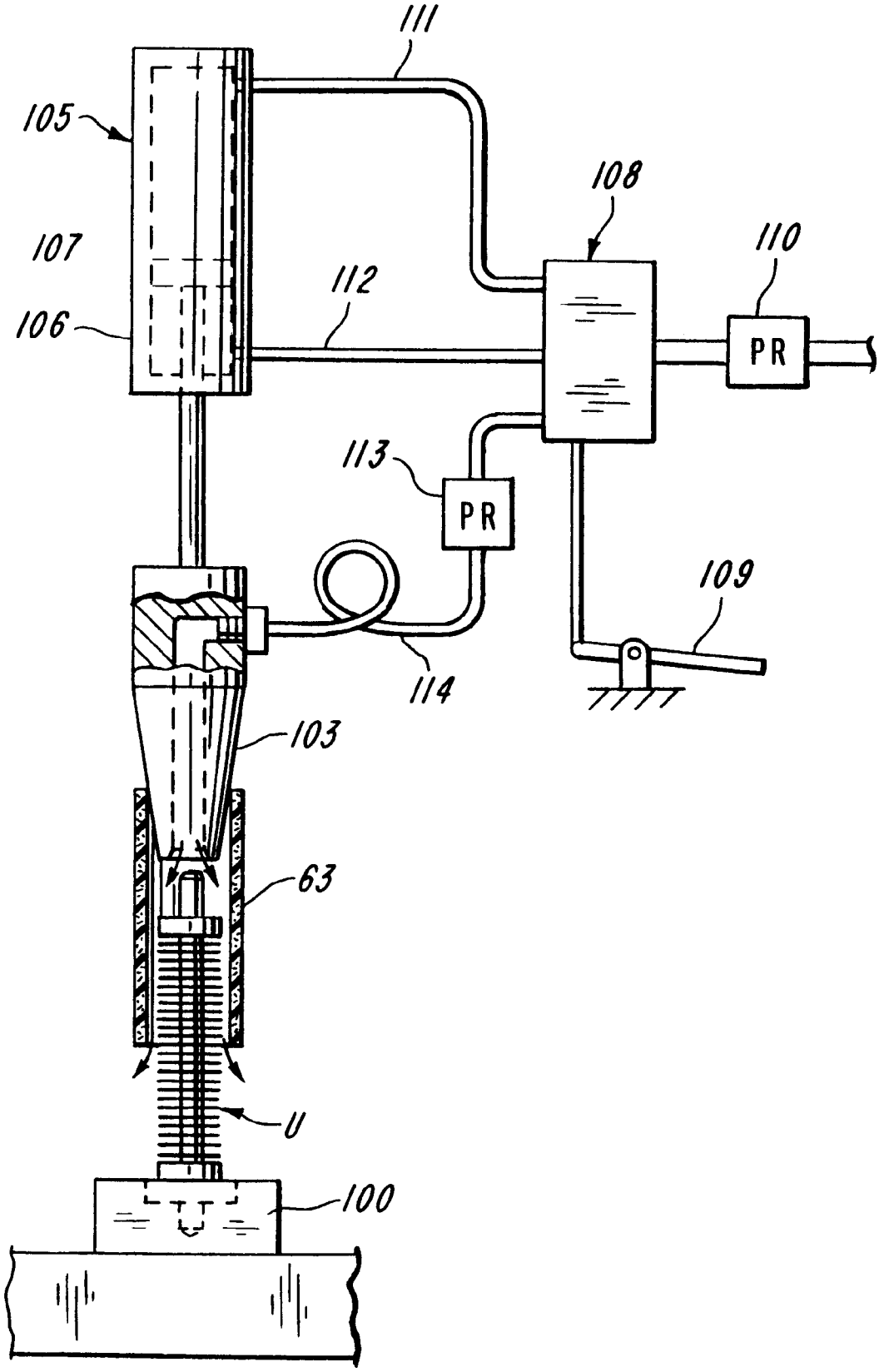
FIG. 8 is a diagrammatic view showing the controls for delivering air under pressure to the interior of the sleeve.

With reference to FIG. 8, the nozzle 103 is shown to be mounted for reciprocal vertical movement by a piston-cylinder mechanism generally indicated at 105'. The mechanism 105' includes a cylinder 106 and a piston 107. A control unit 108 is operated by a foot pedal 109 or the like. In this way, air received from a source and regulated by a pressure regulator 110 passes to the control unit 108 and admits air under pressure either to line 111 or to the line 112 to either lower or raise the nozzle 103. Air under pressure passes from the control unit 108 and passes to a pressure regulator 113 and from there via a flexible line 114 to the nozzle 103. Thus, the nozzle 103 can be raised or lowered at will and its speed of descent of the nozzle 103 can be regulated by the foot pedal 109.

Although it is preferred that the nozzle 103 is mounted for vertical movement, the nozzle 103 can be mounted for horizontal movement or for movement in other directions. Alternatively the nozzle 103 can be mounted to move vertically upward while the air under pressure is expanding the sleeve 63 for placement onto the base.

Instead of a foot pedal operated control, any suitable control such as a hand-operated mechanism can be used.

Figure 7:
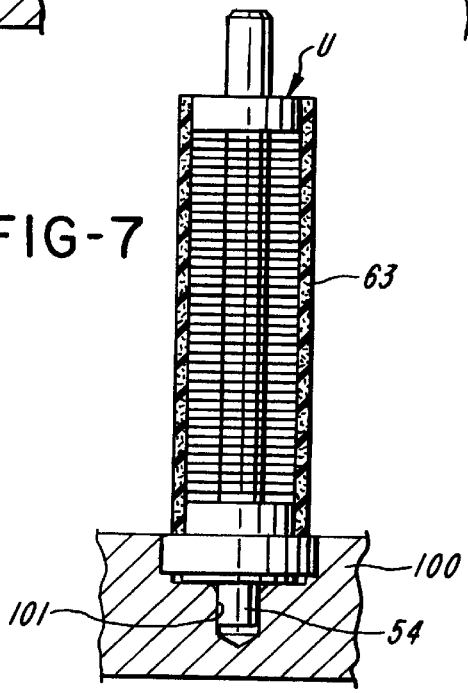
FIG. 7 is a partly sectional view similar to FIG. 6, but showing the sleeve fully assembled onto the base.

When the sleeve 63 has been slipped onto the base U fully to the position shown in FIG. 7, the flange 56 can be pressed onto the stub end 59. Thereupon, the assembly operation is complete. Next, the entire ink roller assembly 50 (or a number of such assemblies) can be inked. The ink roller assembly 50 or assemblies can now be placed in a vat of ink and subjected to a vacuum. Ink will be caused to enter the capillary chambers 62 between the discs 52 and to enter the porous sleeve 63.

It is to be noted that the inking of the ink roller assembly 50 is preferably delayed until the sleeve has been fully slipped onto the base U. This allows for "clean hands" manufacture of the ink roller assembly 50, and it is not until after the ink roller assembly 50 has been assembled that ink roller needs to charged with ink.

Instead of using air under pressure to expand the sleeve 63, the sleeve 63 can be inserted into a cylindrical perforate chamber which is slightly larger than the outside diameter of the sleeve 63 and a vacuum drawn through the perforations to expand the sleeve 63. The expanded sleeve 63 being larger than the base U can easily be inserted fully over the base U, and thereupon the vacuum can be interrupted.

Other embodiments and modifications of the invention will suggest themselves to those skilled in the art, and all such of these as come within the spirit of this invention are included within its scope as best defined by the appended claims.

I claim:

1. Method of making an ink roller assembly, comprising: providing a generally cylindrical elongate base having a series of closely spaced connected discs defining a series of capillary chambers, providing a porous tubular sleeve with an inside diameter smaller that the outside diameter of the base, manually slipping the sleeve part way onto the base without the use of air to partially assemble the sleeve onto the base, thereafter using a nozzle to apply air under pressure between the partially assembled sleeve and base while slipping the sleeve further onto the base, and inking the sleeve and the capillary chambers of the base.

2. Method of making an ink roller assembly, comprising: providing a generally cylindrical elongate base having a series of closely spaced connected discs defining a series of capillary chambers, positioning the base generally vertically in a holder, providing a porous tubular sleeve with an inside diameter smaller that the outside diameter of the base, manually slipping the sleeve part way onto the base, thereafter inserting a nozzle down into the sleeve and expanding the sleeve by use of air under pressure from the nozzle to between the sleeve and the base while slipping the sleeve further onto the base, removing the assembled base and sleeve from the holder, and inking the sleeve and the capillary chambers of the base.

* * * * *